United States Patent [19]

Dau et al.

[11] Patent Number: 5,062,631

[45] Date of Patent: Nov. 5, 1991

[54] BARBELL CLAMP

[76] Inventors: William S. Dau, 4707 Olympia Ave., Beltsville, Md. 20705; Ernest Jaen-Guardia, Jr., 7910 Innkeeper Dr., Severn, Md. 21144

[21] Appl. No.: 524,476

[22] Filed: May 17, 1990

[51] Int. Cl.[5] ..... A63B 21/075

[52] U.S. Cl. ..... 272/123; 403/330

[58] Field of Search ..... 272/117, 123, 122, 124; 403/106, 107, 259, 261, 325, 330

[56] References Cited

U.S. PATENT DOCUMENTS

| | | | |
|---|---|---|---|
| 929,067 | 7/1909 | Williamson | 403/325 X |
| 1,067,367 | 7/1913 | Noster | 403/330 X |
| 1,645,457 | 10/1927 | Schall | 272/123 X |
| 4,249,799 | 2/1981 | Iglesias | 403/330 X |
| 4,569,105 | 2/1986 | Weider | 272/123 X |
| 4,577,837 | 3/1986 | Berg et al. | 403/330 X |
| 4,579,337 | 4/1986 | Oyeda | 272/123 |
| 4,639,979 | 2/1987 | Polsor | 272/123 X |

FOREIGN PATENT DOCUMENTS

| | | | |
|---|---|---|---|
| 629735 | 11/1927 | France | 272/123 |

*Primary Examiner*—Robert Bahr

*Attorney, Agent, or Firm*—Brady, O'Boyle & Gates

[57] ABSTRACT

A clamp for holding interchangeable weights on the end portion of a lift bar of a barbell wherein a hub member, having a pair of spring-biased pivotal jaws, is slidably mounted on the end of the lift bar and engages the outer face of a weight; the jaws engage the lift bar within a selected slot portion provided therein to thereby lock the hub member thereon.

9 Claims, 2 Drawing Sheets

BARBELL CLAMP

BACKGROUND OF THE INVENTION

Barbells used in weight lifting exercise include an elongated lifting bar having interchangeable weights slidably mounted on each end thereof and held thereon by a locking collar. The conventional locking collar comprises a sleeve slidably mounted on each end of the bar and held against the face of the weights by a set screw tightened down against the lifting bar. These locking collars have not been entirely satisfactory because they have a tendency to become loose during the exercise workout, resulting in the weights sliding off the end of the lifting bar, thereby causing injury to the weight lifter and others who might be in the vicinity.

To overcome the disadvantages experienced with the conventional locking collars, a clamping collar of the type disclosed in U.S. Pat. No. 4,579,337, dated Apr. 1, 1986, has been proposed wherein a ball detent is operably connected between the lifting bar and a pair of threadably interconnected cylindrical members. While this type of clamping collar is satisfactory for its intended purpose, its disadvantage is characterized by its plurality of moving parts, and the manipulation required to turn one cylindrical member relative to the other to move the ball detent into the locked or unlocked positions.

To overcome the disadvantages experienced with the prior art barbell clamping collars, after considerable research and experimentation, the clamp of the present invention has been devised which comprises, essentially, a hub member slidably mounted on an end portion of a lifting bar. A pair of semi-circular cooperating jaws are pivotally connected to the hub member, and are spring-biased to a closed, clamping position for engaging a grooved portion in the lifting bar. The clamp is manually actuated to the open position by squeezing handle members provided on the semi-circular jaws to pivot the jaws in a direction away from each other against the biasing force of the spring. By the construction and arrangement of the clamp of the present invention, a clamp is provided which will not become loose during the exercise workout, and is easily manipulated to the open and closed positions. The clamp has fewer moving parts, whereby it is not likely to become inoperable even after long and continued use.

DESCRIPTION OF THE PREFERRED EMBODIMENT

Figure 1:
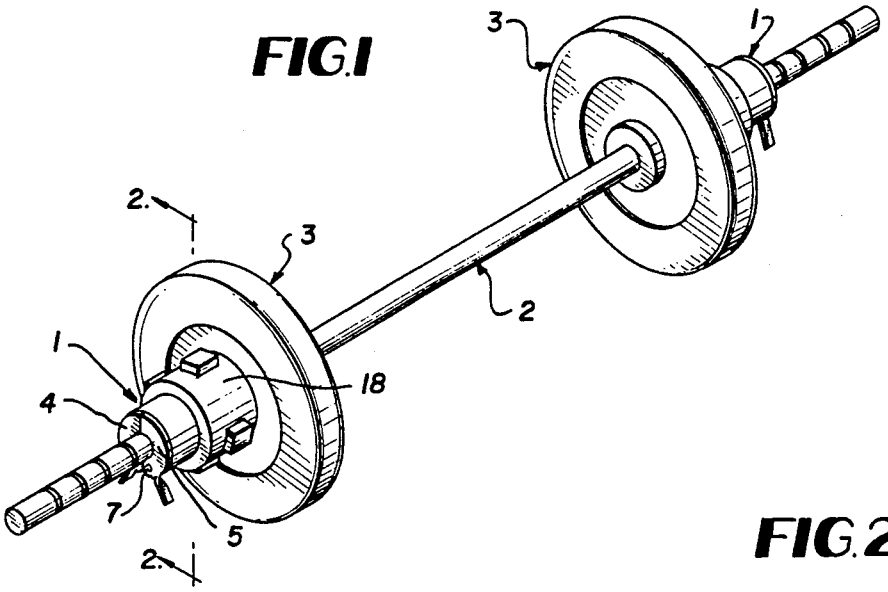
FIG. 1 is a perspective view of the clamp of the present invention mounted in operative position on a barbell lifting bar.

Referring to the drawings and more particularly to FIG. 1, the clamp 1 of the present invention is adapted to be mounted on each end of a lifting bar 2 for holding interchangeable weights 3 thereon.

Figure 2:
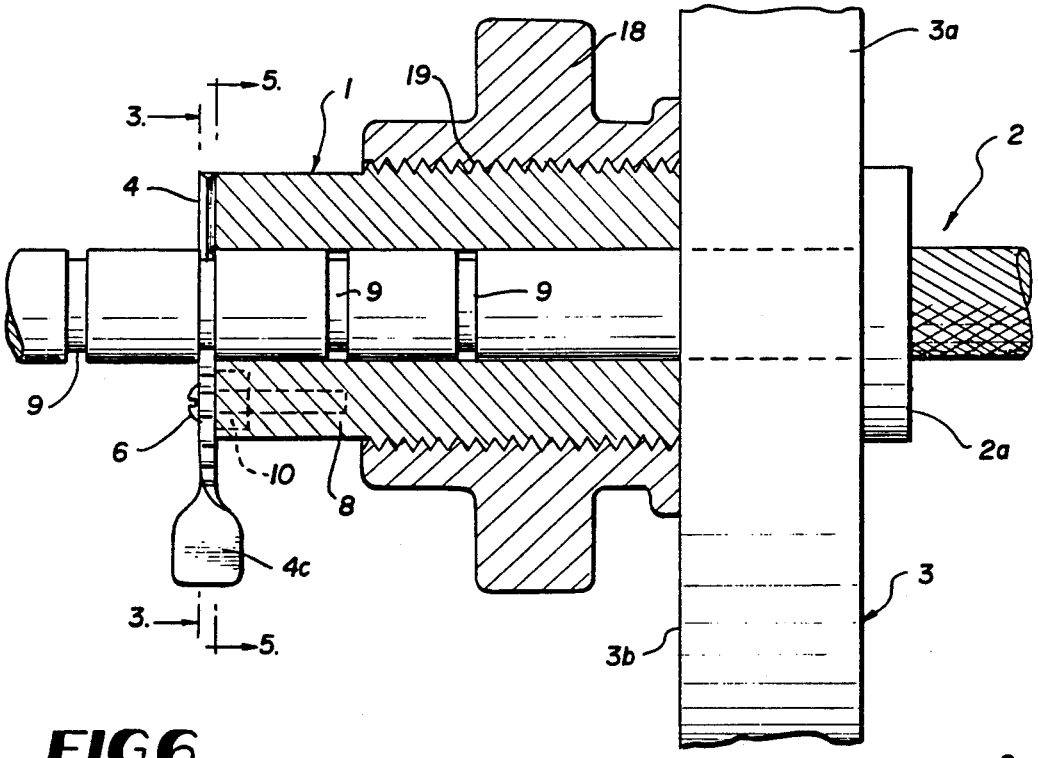
FIG. 2 is an enlarged view taken along line 2—2 of FIG. 1.
Figure 6:
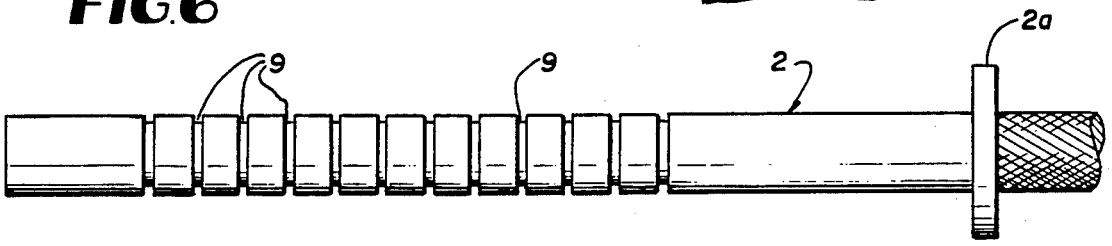
FIG. 6 is a fragmentary, side elevational view of one end of the bar.
Figure 3:
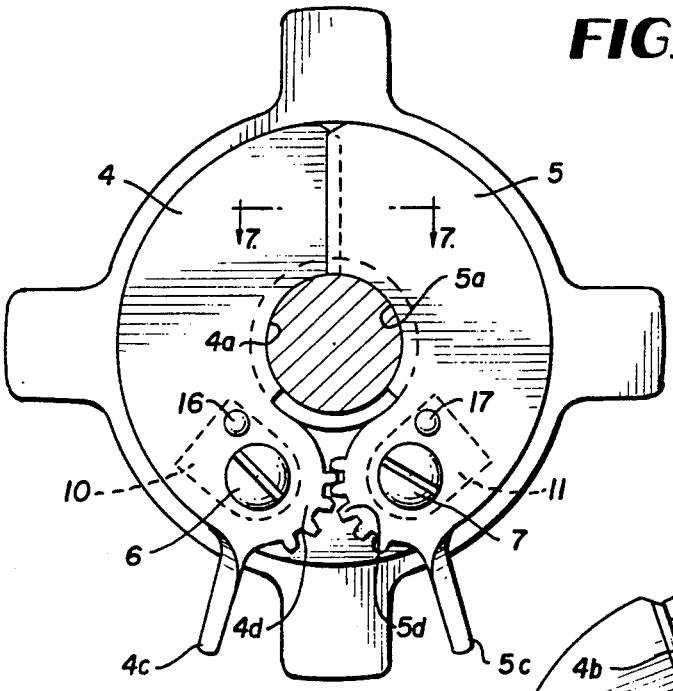
FIG. 3 is a view taken along line 3—3 of FIG. 2.

The details of the construction of the clamp 1 are illustrated in FIGS. 2 and 3 wherein it will be seen that the clamps comprise a pair of semi-circular jaws 4 and 5, pivotally connected as at 6 and 7 to a hub member 8 slidably mounted on the lifting bar 2 having a plurality of longitudinally spaced slots 9 provided therein.

Figure 5:
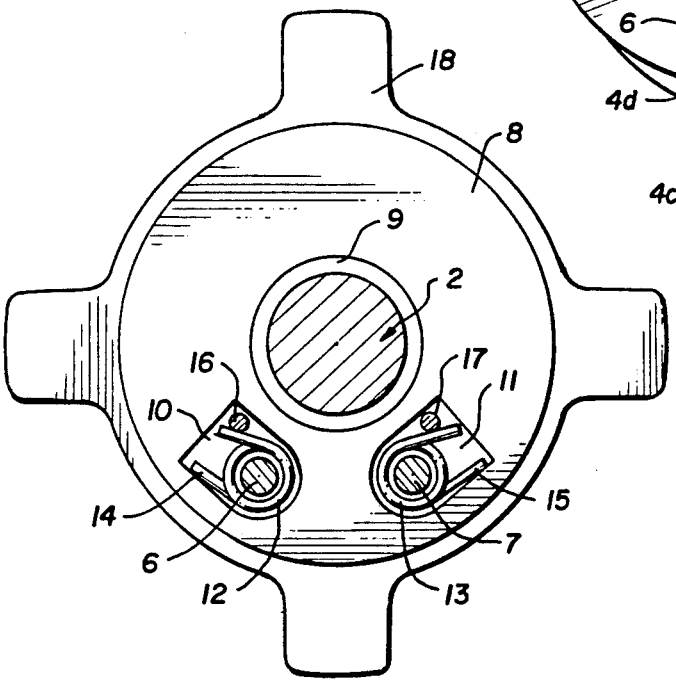
FIG. 5 is a view taken along line 5—5 of FIG. 2.
Figure 7:
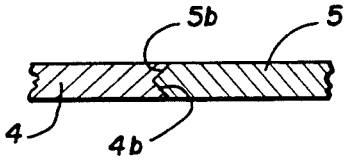
FIG. 7 is a view taken along line 7—7 of FIG. 3.

As will be seen in FIG. 5, the end of the hub 8 is provided with a pair of recesses 10 and 11 for accommodating a pair of torsion springs 12 and 13 coiled around the pivotal connections 6 and 7, respectively. Corresponding ends of the torsion springs 12 and 13 abut a wall of the respective recesses 10 and 11 a at 14 and 15. The opposite ends of the coiled torsion springs 12 and 13 abut axially extending pins 16 and 17 secured to arcuate jaws 4 and 5, respectively. By this construction and arrangement, the semi-circular jaws 4 and 5 are biased to the closed position, whereby the inner peripheral edge portions **4*a* and 5*a* thereof are in gripping engagement within the slot portions 9 of the lifting bar 2. To further enhance the locking action of the clamp, the free end of the jaw 5 is provided with a tongue portion 5*b* receivable within a correspondingly configured grooved portion 4*b* provided in the free end portion of jaw 4**.

In order to facilitate the pivoting of the jaws to the open position, each jaw 4 and 5 has a handle portion **4*c* and 5*c*, and in order that each jaw 4 and 5 can move an equal distance when being pivoted about the pivotal connections 6 and 7, they are provided with cooperating, intermeshing gear segment portions 4*d* and 5*d***.

Figure 4:
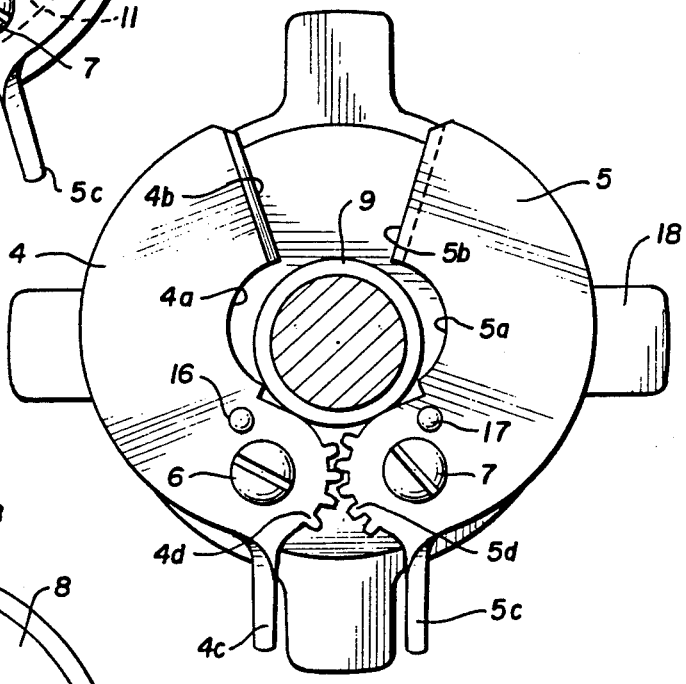
FIG. 4 is an elevational view similar to FIG. 3 but showing the jaws of the clamp pivoted to the open position.

In using the clamp of the present invention, each weight 3 is slidably mounted onto each end of the lift bar 2 until the inner face **3*a* thereof abuts the flange portion 2*a* of the lift bar. While holding the jaws 4 and 5 in the open position, as shown in FIG. 4, the hub member 8 is slid onto the bar 2 until it abuts the outwardly extending face 3*b* of the weight. The open jaws 4 and 5 are then released to become spring-biased to the closed position as shown in FIG. 3**.

While the clamp 1 will not become loose on the lift bar 2 during the exercise workout, to further enhance the locking thereof and to compensate for any clearance between the end of the hub member 8 and the outer face **3*b* of the weight 3, a collar 18 is threadably mounted on the hub 8 as at 19**.

From the above description, it will be readily apparent to those skilled in the art that the barbell clamp of the present invention is an improvement over the clamps or collars heretofore employed. Its simplicity of construction facilitates the manipulation of the clamp on the lift bar, and the construction and arrangement of the spring-biased circular jaws 4 and 5 gripping the lift bar 2 within a selected slot portion 9 prevents the clamp from becoming loose during the exercise workout.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A barbell comprising, a lift bar, a plurality of longitudinally spaced slots provided on each end portion of said lift bar, interchangeable weights slidably mounted on each end portion of said lift bar, a flange on each end portion of the lift bar, the inner face of a weight on each end portion of the bar abutting a respective flange, and a clamp assembly connected to each end portion of the lift bar to prevent the weights from sliding off each end of the bar, each clamp assembly comprising a hub member slidably mounted on the end portion of the lift bar and abutting the outer face of the weight, a pair of semi-circular jaws pivotally connected to the hub member and engaged within a selected lift bar slot, whereby the end of the hub member is held against the outer face of the weight to thereby prevent the clamp assembly from becoming loose during the exercise workout.

2. A clamp according to claim 1, wherein a collar is threadably mounted on the hub and engageable with the outer face of the weight.

3. A clamp according to claim 1, wherein a spring is operably connected between the hub member and each jaw, whereby the jaws are biased to the closed position.

4. A clamp according to claim 3, wherein the spring comprises a torsion spring coiled around the pivotal connection of the jaw to the hub.

5. A clamp according to claim 4, wherein a recess is provided in the end of the hub member and an axially extending pin is connected to the jaw, one end of the coiled torsion spring abutting a wall of the recess and the other end of the torsion spring abutting the pin.

6. A clamp according to claim 1, wherein a handle portion is provided on each jaw.

7. A clamp according to claim 1, wherein the free end of one jaw is provided with a tongue portion which cooperates with a correspondingly configured groove portion provided in the free end of the other jaw.

8. A clamp for a barbell of the type having interchangeable weights slidably mounted on a lift bar having a plurality of longitudinally spaced slots, and a flange against which the inner face of the weight abuts, said clamp comprising a hub member slidably mounted on the end of the lift bar and abutting the outer face of the weight, a collar threadably mounted on the hub and engageable with the outer face of the weight, a pair of semi-circular jaws pivotally connected to the hub member and engageable within the selected lift bar slots, whereby the end of the hub member is held against the outer face of the weight, to thereby prevent the clamp from becoming loose during the exercise workout.

9. A clamp for a barbell of the type having interchangeable weights slidably mounted on a lift bar having a plurality of longitudinally spaced slots, and a flange against which the inner face of the weight abuts, said clamp comprising a hub member slidably mounted on the end of the lift bar and abutting the outer face of the weight, a pair of semi-circular jaws pivotally connected to the hub member and engageable within selected bar slots, the free end of one jaw having a tongue portion cooperating with a correspondingly configured groove provided in the free end of the other jaw, whereby the end of the hub member is held against the outer face of the weight, to thereby prevent the clamp from becoming loose during the exercise workout.

* * * * *